US005291379A

United States Patent [19]

Lu

[11] Patent Number: 5,291,379

[45] Date of Patent: Mar. 1, 1994

[54] PROTECTIVE LAMP-SHADE

[76] Inventor: Jem Dong Lu, No. 36, Lane 360, Chung Cheng Road., Pan Chiao City, Taipei Hsien, Taiwan

[21] Appl. No.: 40,206

[22] Filed: Apr. 1, 1993

[51] Int. Cl.[5] ..... F21M 3/14

[52] U.S. Cl. ..... 362/255; 362/260; 362/377; 362/348

[58] Field of Search ..... 362/255, 256, 260, 376, 362/377, 348, 306, 310, 361, 455

[56] References Cited

U.S. PATENT DOCUMENTS 2,467,096 4/1949 Ressinger ..... 362/255
4,924,368 5/1990 Nothrop et al. ..... 362/260 X
5,188,451 2/1993 Shanks ..... 362/260 X

*Primary Examiner*—Stephen F. Husar
*Attorney, Agent, or Firm*—Pro-Techtor International

[57] ABSTRACT

Disclosed is a protective lamp-shade consisted of a cylindrical shell molded from polycarbonate resin, and two silicone rubber end caps mounted on the lamp tube of a lamp assembly at two opposite ends to hold the cylindrical shell in place, wherein the cylindrical shell has parallel teeth around the inside or outside wall to refract the light of the lamp tube of the lamp assembly, and is peripherally and partially coated with a layer of white zinc coating along its length for reflecting the light of the lamp tube of the lamp assembly.

6 Claims, 5 Drawing Sheets

PROTECTIVE LAMP-SHADE

BACKGROUND OF THE INVENTION

The present invention relates to lamp-shades, and more specifically the present invention relates to a protective lamp-shade for protecting the lamp tube of a lamp assembly.

Various lighting fixtures have been proposed for use in different situations, or for different purposes. Among conventional lighting fixtures, fluorescent lamps are commonly used in offices and houses for illumination. However, a fluorescent lamp may flash, more particularly after a length of time in use, and the lamp tube of a fluorescent lamp is fragile. If the lamp tube of a fluorescent lamp is broken, the fragments may go off in all directions to injure people therebelow.

SUMMARY OF THE INVENTION

The present invention has been accomplished under the aforesaid circumstances. It is therefore an object of the present invention to provide a protective lamp-shade which is durable in use. It is another object of the present invention to provide a protective lamp-shade for a lamp tube which protects the fragments of the lamp tube from going off in all directions as the lamp tube is broken. It is still another object of the present invention to provide a protective lamp-shade which can be conveniently adjusted to regulate the angle of reflection of the light of the lamp tube being protected.

According to the present invention, the protective lamp-shade is comprised of a cylindrical shell molded from polycarbonate resin, and two end caps respectively made from silicone rubber. Each end cap has a center hole for inserting either end of the lamp tube to be protected, and an annular groove at one end into which either end of the cylindrical shell fits. The cylindrical shell has parallel teeth over the inside or outside wall along its length, and is partially coated with a layer of mercury or nickel along its length to form a reflector. The cylindrical shell can be rotated on the end caps to regulate the angle of reflection.

BRIEF DESCRIPTION OF THE DRAWINGS

FIG. 2(A) is a plan view of different cylindrical shells according to the present invention, of which each having parallel teeth around the respective inside wall along the respective length;

DETAILED DESCRIPTION OF THE PREFERRED EMBODIMENTS

Figure 1:
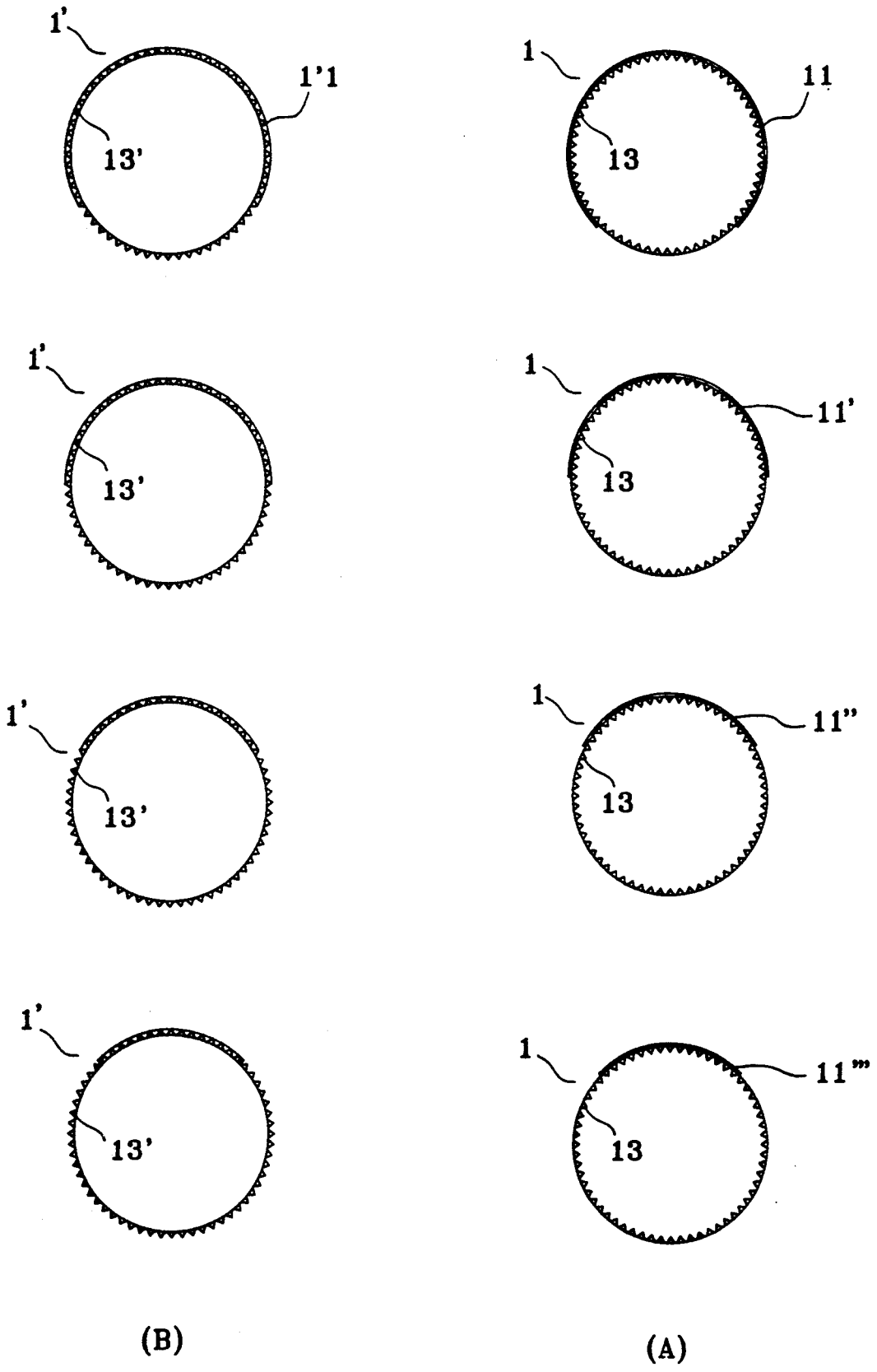
FIG. 1(B) is a plan view of different cylindrical shells according to the present invention, of which each having parallel teeth around the respective outside wall along the respective length.
Figure 2:
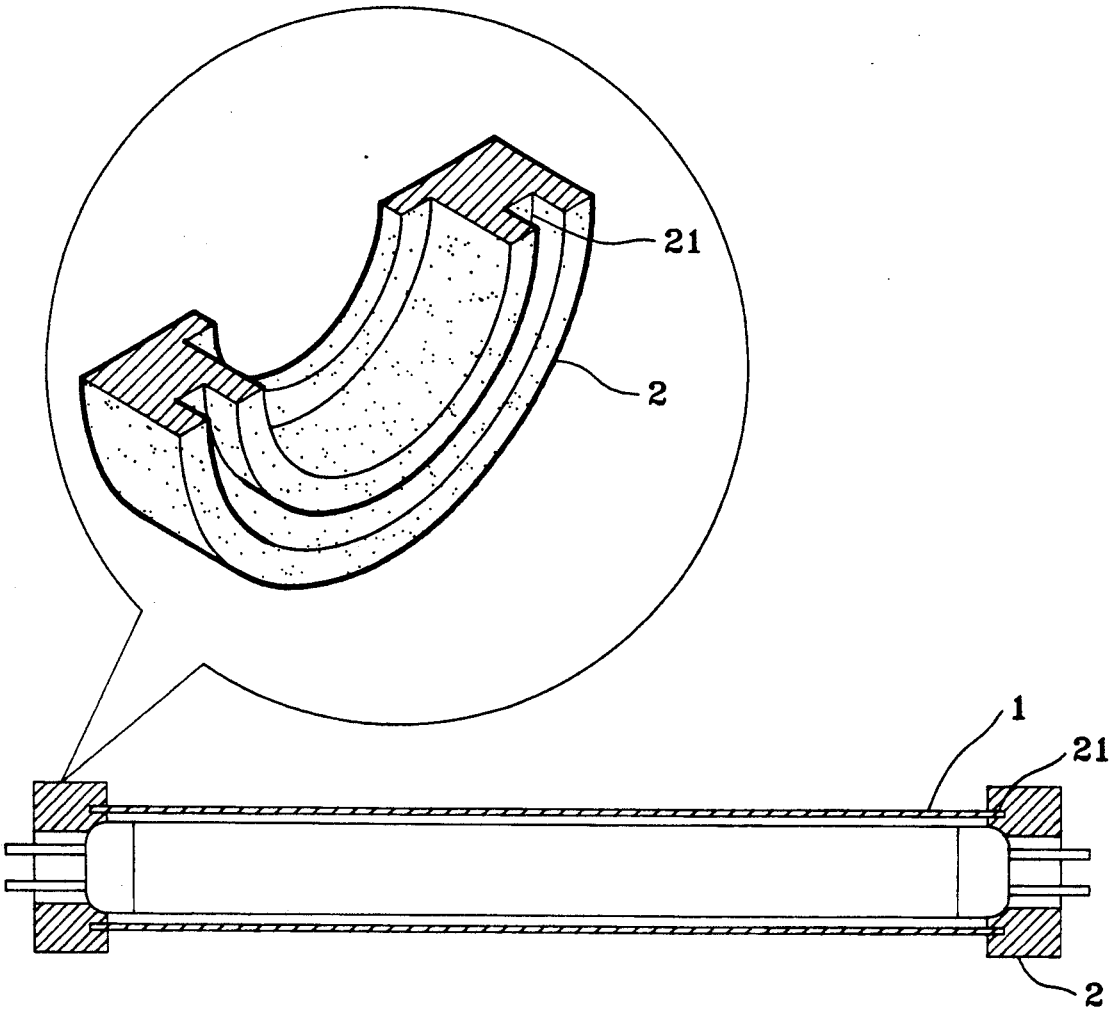
FIG. 2 is a sectional plan showing the protective lamp-shade mounted on the lamp tube of a lamp, and an enlarged and partially cut-off view of an end cap according to the present invention.
Figure 3:
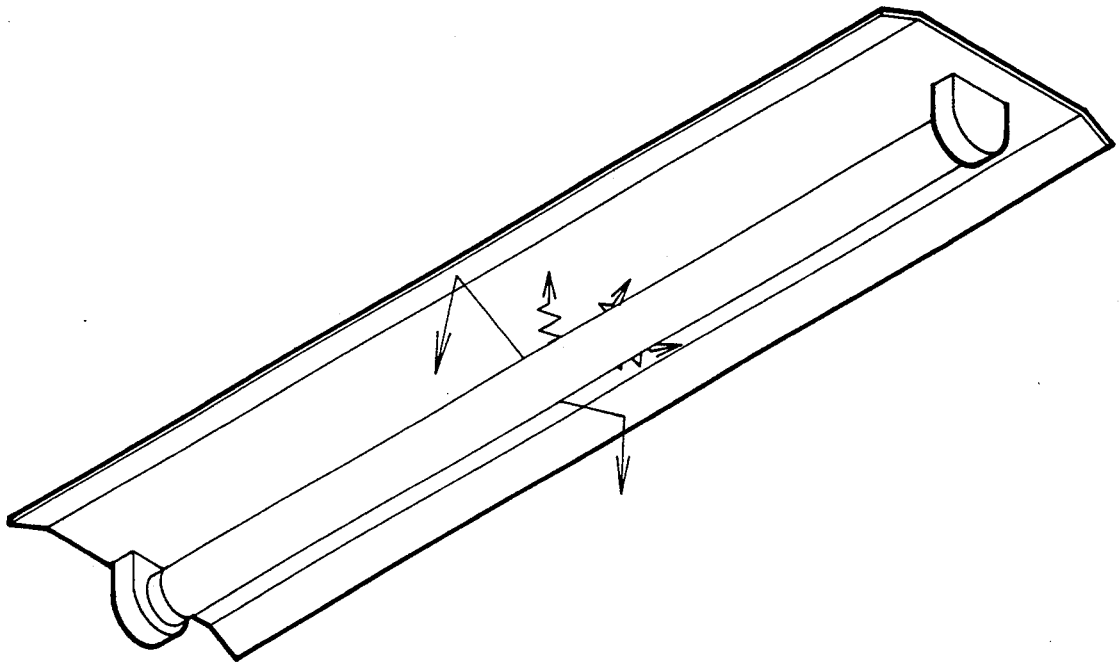
FIG. 3 illustrates the effect of the reflector on a fluorescent lamp assembly according to the prior art.

Referring to FIGS. 1 and 2, a protective lamp-shade in accordance with the present invention is generally comprised of a cylindrical shell 1 integrally molded from polycarbonate resin, and two end caps 2 respectively made from silicone rubber. The cylindrical shell 1 has unitary parallel teeth 13 around the inside wall along its length, and is peripherally and partially coated with a layer of light reflecting metal 11 along its length. The light reflecting metal can be mercury or nickel. The layer of light reflecting metal 11 may be directly covered over the cylindrical shell 1 by painting or through a vacuum plating process. The width of the layer of light reflecting metal 11 may be determined according to different requirements. For example, the layer of light reflecting metal 11 may cover over the outside surface of the cylindrical shell 1 through 120° (as referenced by 11 in FIG. 1), 90° (as referenced by 11, in FIG. 1), 60° (as referenced by 11" in FIG. 1) or 45° angle (as referenced by 1111, in FIG. 1). The two end caps 2 are respectively attached to the cylindrical shell 1 at two opposite ends, having each an annular groove 21 on a respective inner side into which either end of the cylindrical shell 1 fits. Of course, each end cap 2 has a center hole for inserting either end of the lamp tube to be protected. When installed, the cylindrical shell 1 can be rotated on the end caps 2 relative to the lamp tube for regulating the angle of reflection.

On the left side of FIG. 1, there is illustrated an alternate form of the cylindrical shell. In this alternate form, the cylindrical shell 1' has unitary parallel teeth 13' around the outside wall along its length, and is peripherally and partially coated with a layer of light reflecting metal 1'1 along its length.

The layer of light reflecting metal 11;1'1 serves as a reflector to reflect the light of the lamp tube. Even if the layer of light reflecting metal is covered with a layer of dust, its performance (light reflecting function) is not affected. Further, because the cylindrical shell 1;1' is made from polycarbonate resin, it does not deform under the radiation of the light and heat of the lamp tube.

Figure 4:
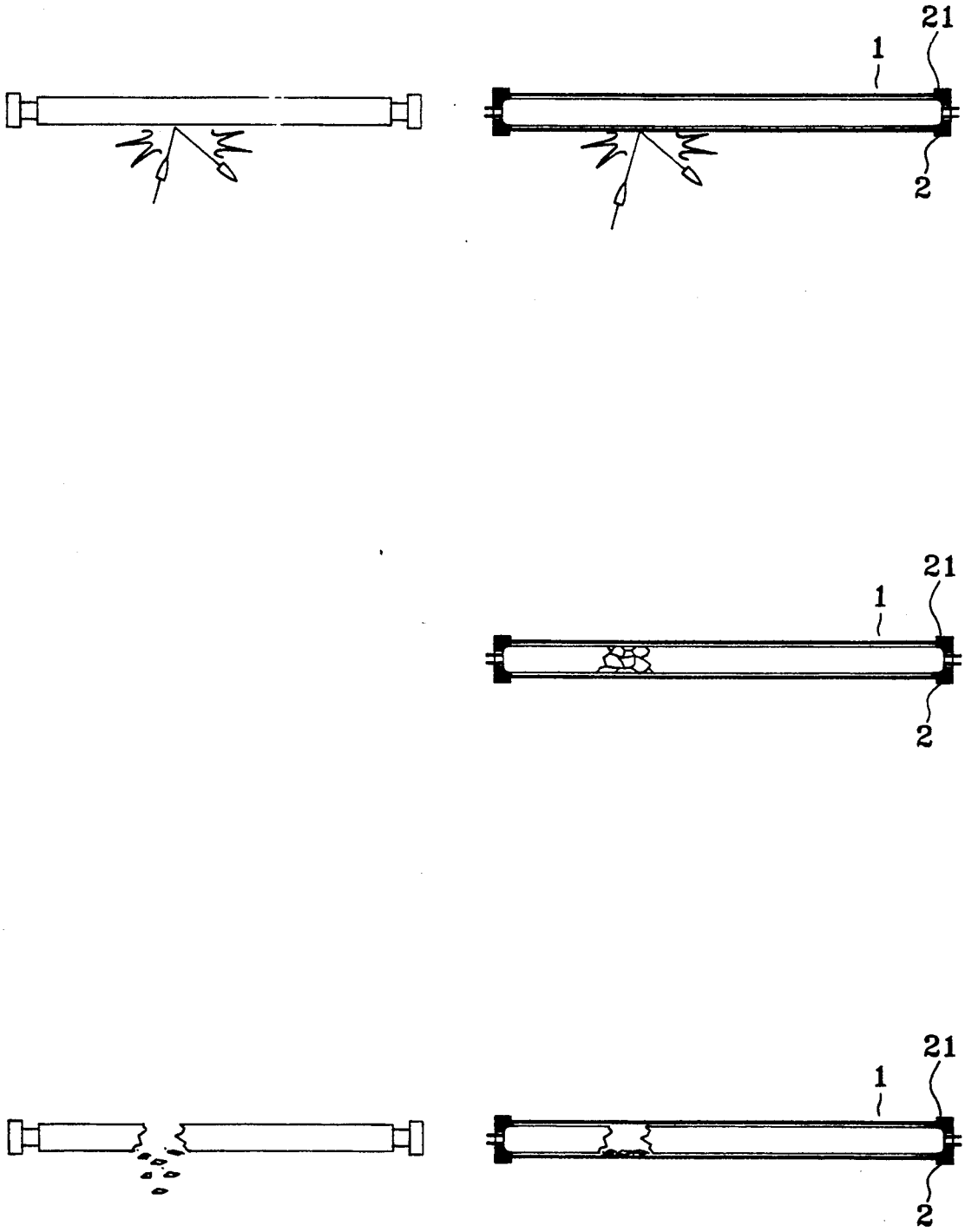
FIG. 4 is a pictorial drawing showing different possible conditions of a broken lamp tube with and without the protective lamp-shade.

Referring to FIG. 4, if the lamp tube is broken, the fragments of the broken lamp tube will be still maintained inside the cylindrical shell of the protective lamp-shade. If the lamp tube is not protected by the protective lamp-shade, the fragments will fall from the housing of the lamp and go off in all directions.

Figure 5:
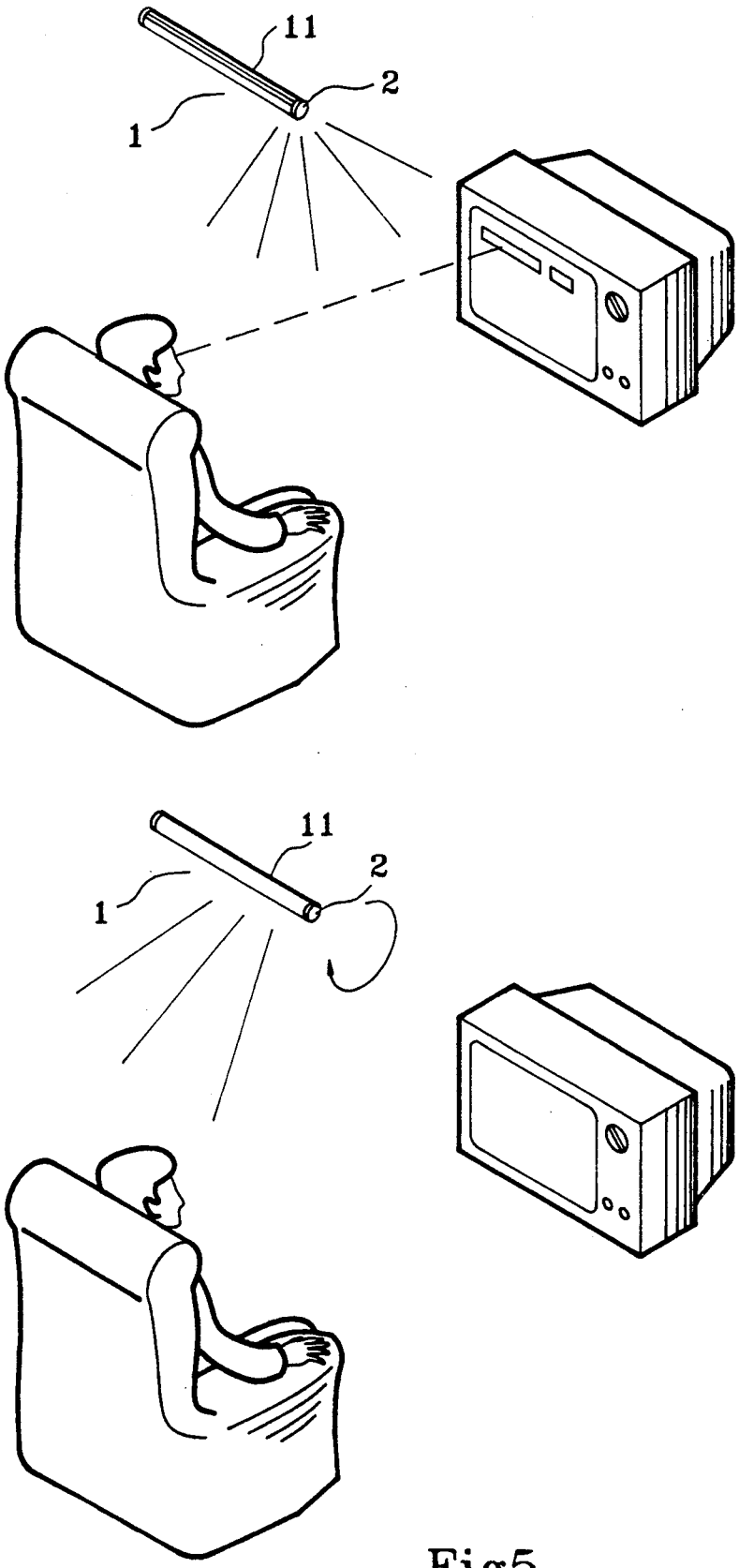
FIG. 5 is a pictorial drawing showing the cylindrical shell turned on the end caps to eliminate the reflection image from the screen of a TV.

Referring to FIG. 5, if the lamp produces a reflection image on the screen of a TV, the cylindrical shell can be turned on the end caps through a certain angle to eliminate the reflection image.

What is claimed is:

1. A protective lamp-shade comprising a cylindrical shell integrally molded from polycarbonate resin and covered around the lamp tube of a lamp assembly, and two end caps respectively made from silicone rubber and mounted on the lamp tube of said lamp assembly at two opposite ends to hold said cylindrical shell in place for permitting said cylindrical shell to be turned round relative to the lamp tube of said lamp assembly, said cylindrical shell having parallel teeth along its length for refracting the light of the lamp tube of said lamp assembly and being peripherally and partially coated with a layer of light reflecting metal coating along its length for reflecting the light of the lamp tube of said lamp assembly.

2. The protective lamp-shade of claim 1 wherein said parallel teeth are made on said cylindrical shell around the inside wall.

3. The protective lamp-shade of claim 1 wherein said parallel teeth are made on said cylindrical shell around the outside wall.

4. The protective lamp-shade of claim 1 wherein each end cap has an annular groove on a respective inner side into which either end of said cylindrical shell fits.

5. The protective lamp-shade of claim 1 wherein said light reflecting metal coating is mercury.

6. The protective lamp-shade of claim 1 wherein said light reflecting metal coating is nickel.

* * * * *